US008322444B2

(12) United States Patent
De Camargo

(10) Patent No.: US 8,322,444 B2
(45) Date of Patent: Dec. 4, 2012

(54) SURFACE REFILLABLE PROTECTOR

(75) Inventor: Lauro De Camargo, Midland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 258 days.

(21) Appl. No.: 12/570,636

(22) Filed: Sep. 30, 2009

(65) Prior Publication Data

US 2011/0073316 A1 Mar. 31, 2011

(51) Int. Cl.
*E21B 43/00* (2006.01)

(52) U.S. Cl. ..... 166/369; 166/68; 166/105

(58) Field of Classification Search ..... 166/369, 166/68, 69, 72, 105
See application file for complete search history.

(56) References Cited

U.S. PATENT DOCUMENTS 5,201,848 A * 4/1993 Powers ..... 415/199.1
5,375,656 A * 12/1994 Wilson ..... 166/67
6,595,295 B1 * 7/2003 Berry et al. ..... 166/369
6,602,059 B1 * 8/2003 Howell et al. ..... 417/423.3
6,684,946 B2 * 2/2004 Gay et al. ..... 166/105
7,326,034 B2 * 2/2008 Sheth et al. ..... 415/199.2
7,367,400 B1 * 5/2008 Howell ..... 166/310
7,378,769 B2 * 5/2008 Head ..... 310/87
7,730,937 B2 * 6/2010 Head ..... 166/66.4
7,828,058 B2 * 11/2010 Fielder ..... 166/250.15
2005/0269885 A1 * 12/2005 Knox et al. ..... 310/87
2006/0037743 A1 * 2/2006 Head ..... 166/66.4
2006/0175064 A1 * 8/2006 Yuratich ..... 166/381

* cited by examiner

*Primary Examiner* — Nicole Coy
(74) *Attorney, Agent, or Firm* — Jim Patterson

(57) ABSTRACT

An electric pumping system having an electric submersible pump located downhole in a well, the electric submersible pump comprising a motor part, a pump part, and a protector part; the motor part has an internal motor volume containing motor oil; the motor part connected to an electric power source at surface; a motor oil container located at surface outside of the well; a conduit fluidly connecting the motor oil container with the internal motor volume containing motor oil.

15 Claims, 1 Drawing Sheet

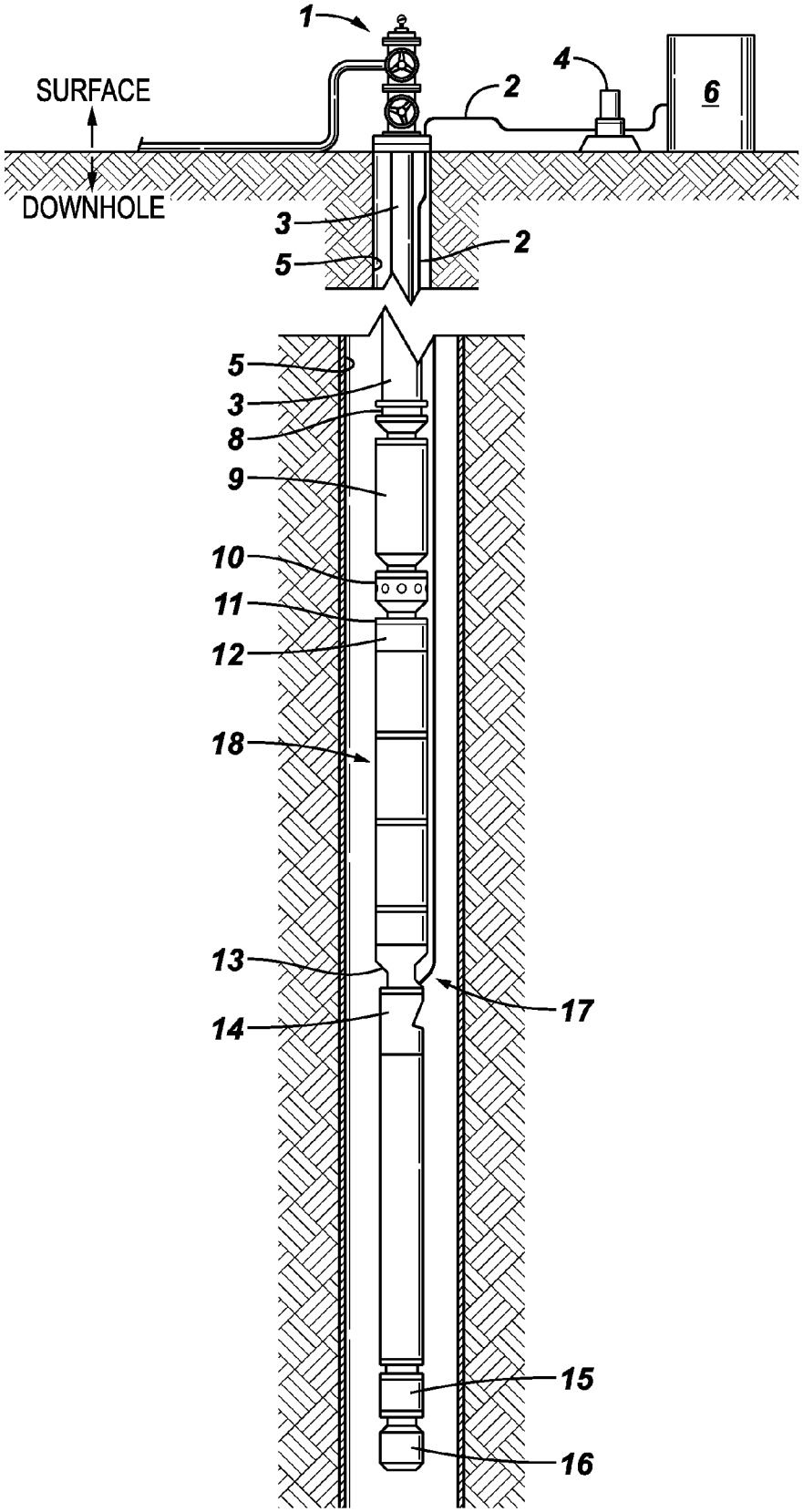
1
SURFACE
DOWNHOLE
2
4
6
3
5
2
5
3
8
9
10
11
12
18
13
14
17
15
16

SURFACE REFILLABLE PROTECTOR

TECHNICAL FIELD

The present application relates to electric submersible pump (ESP) devices, and more specifically to the filling of an ESP with motor oil from surface during operation downhole.

BACKGROUND

A variety of production fluids are pumped from subterranean environments. Different types of submersible pumping systems may be disposed in production fluid deposits at subterranean locations to pump the desired fluids to the surface of the earth.

For example, in producing petroleum and other useful fluids from production wells, it is generally known to provide a submersible pumping system for raising the fluids collected in a well. Production fluids, e.g. petroleum, enter a wellbore drilled adjacent a production formation. Fluids contained in the formation collect in the wellbore and are raised by the submersible pumping system to a collection point at or above the surface of the earth.

A typical submersible pumping system comprises several components, such as a submersible electric motor that supplies energy to a submersible pump. The system further may comprise a variety of additional components, such as a connector used to connect the submersible pumping system to a deployment system. Conventional deployment systems include production tubing, cable, and coiled tubing. Additionally, power is supplied to the submersible electric motor via a power cable that runs through or along the deployment system.

Often, the subterranean environment (specifically the well fluid) and fluids that are injected from the surface into the wellbore (such as acid treatments) contain corrosive compounds that may include $CO_2$, $H_2S$ and brine water. These corrosive agents can be detrimental to components of the submersible pumping system, particularly to internal electric motor components, such as copper windings and bronze bearings. Moreover, irrespective of whether or not the fluid is corrosive, if the fluid enters the motor and mixes with the motor oil, the fluid can degrade the dielectric properties of the motor oil and the insulating materials of the motor components. Accordingly, it is highly desirable to keep these external fluids out of the internal motor fluid and components of the motor.

Submersible electric motors are difficult to protect from corrosive agents and external fluids because of their design requirements that allow use in the subterranean environment. A typical submersible motor is internally filled with a fluid, such as a dielectric oil, that facilitates cooling and lubrication of the motor during operation. As the motor operates, however, heat is generated, which, in turn, heats the internal motor fluid causing expansion of the oil. Conversely, the motor cools and the motor fluid contracts when the submersible pumping system is not being used. Motor protectors are used to address that issue.

Numerous types of motor protectors have been designed and used in isolating submersible motors while permitting expansion and contraction of the internal motor fluid. A variety of elastomeric bladders alone or in combination with labyrinth sections have been used as a barrier between the well fluid and the motor fluid. For example, expandable elastomeric bags or bladders have been used in series to prevent mixing of wellbore fluid with motor fluid while permitting expansion and contraction of the motor fluid.

In this latter design, the motor protector includes a pair of chambers each of which has an elastomeric bladder. The first bladder is disposed in a first chamber of the pair of chambers and includes an interior in fluid communication with the motor. This fluid communication permits motor oil to flow from the motor into the elastomeric bladder during expansion and to flow from the elastomeric bladder back to the motor during contraction.

The second chamber also has an expandable bladder, filled with motor oil, which is in fluid communication with the first chamber but external to the first elastomeric bladder. The second chamber is vented or open to the wellbore environment. This assembly permits fluid to flow between the second elastomeric bladder and the adjacent chamber as the first elastomeric bladder expands or contracts. Simultaneously, wellbore fluid is allowed to flow in and out of the second chamber, external to the second elastomeric bladder, to permit equalization of pressure as the second bladder expands and contracts.

The conventional labyrinth type protector uses the difference in specific gravity of the well fluid and the motor fluid to separate the fluids. For example, a typical labyrinth may embody a chamber having a first passageway to the motor fluid and a second passageway to an undesirable fluid, such as fluids in the wellbore. The first and second passageways are generally oriented on opposite sides of the chamber to maintain fluid separation in a vertical orientation.

Another type of protector uses metal bellows to provide a movable barrier between the internal motor fluid and corrosive well fluids. The metal bellows expand and contract to compensate for pressure and volume variations between the internal motor fluid and the wellbore fluid.

Each style of protector may have a one-way check valve associated therewith that will allow any excess motor fluid to escape if/when the capacity of the protector is exceeded.

Given that, it is desirable to prevent detrimental effects of contamination of motor oil used in ESPs. The present application includes designs and/or methods addressing those needs.

SUMMARY

The present application relates to an embodiment of an electric pumping system. An electric submersible pump is located downhole in a well. The electric submersible pump has a motor part, a pump part and a protector part. The motor part has an internal motor volume containing motor oil. The motor part is connected to an electric power source at surface. A motor oil container is located at surface outside of the well. A conduit is fluidly connecting the motor oil container with the internal motor volume containing motor oil.

BRIEF DESCRIPTION OF THE DRAWINGS

The following is a brief description of the FIGURE herein and is not meant in any way to be unduly limiting to any present or future claims related to the present application.

FIG. 1 shows an embodiment of an electric submersible pumping system.

DETAILED DESCRIPTION

The following description concerns a number of embodiments and is meant to provide an understanding of the various embodiments. The description is not in any way meant to unduly limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

A benefit of the present design is to extend the run life of an electric submersible pump (ESP) by injecting dielectric oil into an electric submersible pump (e.g., a protector part or a motor part) from the surface at various times, e.g., while the motor is running, at startup, or after shutdown. In other words, the motor oil is provided from surface at such a pressure so as to overcome the wellbore pressure, i.e., to create a positive pressure from the injected motor oil in the motor part. One of the main failure causes on ESP systems is saturation of the protector with well fluids thereby resulting in motor contamination and then electric short circuit. That situation is encouraged by frequent start-ups and shut downs of an ESP motor. Frequent start-ups and shut downs cause the oil to expand and compress due to temperature changes. When oil volume compresses, well fluids tend to bypass the protector, e.g., a labyrinth protector.

According to an embodiment of the present application, an oil container on the surface will refill the ESP protector through a capillary tube (i.e., a fluid conduit) to help prevent ingress of well fluid into the protector and/or motor.

A beneficial aspect of this design is that few changes in the protector and overall ESP design will be necessary to achieve the benefits noted herein.

FIG. 1 shows a present embodiment of an electric submersible pumping system. A wellhead 1 is located at surface. An oil container 6 is located at surface and can be in proximity to the wellhead 1. An oil line 2 is connected with the oil container 6. An injection pump 4 is connected with the oil line 2. The injection pump 4 is configured and connected to pump motor oil from the oil container 6 though the oil line 2 and downhole. The oil line 2 extends down into the well. Production tubing 3 extends from the wellhead 1 downhole into the well. The well can be lined with casing 5.

The production tubing 3 connects with an electric submersible pump (ESP) 18. The ESP 18 comprises a pump part 9, a protector part 11, and a motor part 14. The motor part 14 contains motor oil. The pump part 9 can include and be connected with an intake 10. The pump part 9 can also include and be connected with a discharge 8. The pump part 9 is generally a centrifugal style pump that includes diffusers and impellers in series. The diffusers and impellers are rotated with respect to one another by a shaft, e.g., a drive shaft mechanically connected with the motor part 14. Suitable pumps are available commercially from Schlumberger™.

The protector part 11 connects generally below the pump part 9 and provides a separation between motor oil from the motor part and well fluid from the pump part 9 etc. The protector part 11 can include a labyrinth style protector, a bag style protector, and/or a metal bellows style protector. Protectors are available commercially from Schlumberger™ in each of those styles. The protector part 11 may include and be connected with a modified protector base having a hydraulic connector 13 that connects with the oil line 2. The hydraulic connector can include a Swagelok™ connector. Swagelok™ connectors are commercially available. The protector part 11 has an internal volume that contains motor oil. The hydraulic connector 13 may include a one-way check valve that only allows flow into the protector part 11. The internal volume containing motor oil is separated from a volume containing fluids other than motor oil, e.g., well fluid or other non-motor oil fluids. As noted earlier, the separation of the motor oil from the other-than-motor oil can be maintained by way of a labyrinth protector, a bag protector, and/or a metal bellows protector.

A modified protector head 12 may be included and include a check valve and/or mesh type filter.

During expansion of motor oil in the motor part 14, the volume of motor oil in the protector part 11 similarly expands and the protector part 11 compensates for that expansion and in turn expels an amount of well fluid from the protector part 11. As can be understood in connection with a labyrinth protector, the additional motor oil volume may extend into the part of the protector for maintaining well fluid. Also, in connection with metal bellows and/or bag style protectors, check valve(s) may allow for excess motor oil volume to escape when capacity of the metal bellows or bag is reached. In either situation, it is beneficial to provide additional motor oil into the motor part 14 and/or the protector part 11 that contains the motor oil during use and/or operation of the pump and motor. This can be accomplished by providing motor oil via the conduit 2 at a pressure so as to create a positive pressure. That addition of motor oil will lessen the chances of ingress of contaminants into the motor oil in the protector part 11 during expansion/contraction of the motor oil in the motor part 14.

The motor part 14 is generally connected below the protector part 11. The motor part 14 includes a tubular housing having included therein rotors and stator coils. A drive shaft is connected through the motor and connects mechanically with the pump part 9. The drive shaft extends through the protector part 11. The motor part 14 is electrically connected to a power source, e.g., at surface. The motor part 14 can be electrically connected by way of an electrical cable. Motors of this type are available commercially from Schlumberger™. The motor part 14 may include a hydraulic connector that connects with the oil line 2, thereby connecting the oil line 2 to an internal part of the motor 14 that contains motor oil. The hydraulic connector could include a Swagelok™ connector. The hydraulic connector could also include a one-way check valve that only allows motor oil to flow from the oil line 2 into the motor part 14.

The description herein is meant to provide understanding of various embodiment to one skilled in the art. The description herein is mean in no way to unduly limit the interpreted scope of any present or subsequent claims related to the present application.

The invention claimed is:

1. An electric pumping system, comprising:

an electric submersible pump located downhole in a well, the electric submersible pump comprising a motor part, a pump part, and a protector part positioned between the pump part and the motor part, the protector part having an internal volume containing motor oil and a volume exposed to fluid other than motor oil;

the motor part has an internal motor volume containing motor oil;

the motor part connected to an electric power source at surface;

a motor oil container located at surface outside of the well; and a conduit coupled to a base of the protector part and fluidly connecting the motor oil container with both the motor part and the protector part to supply motor oil to both the motor part and the protector part at a location above the motor part, the motor oil being maintained at a positive pressure via pressure applied through the conduit.

2. The electric pumping system of claim 1, wherein a hydraulic connector is located at the base of the protector, the hydraulic connector connecting with the conduit thereby allowing for fluid communication between the conduit and the interior of the protector containing motor fluid.

3. The electric pumping system of claim 2, wherein the hydraulic connector comprises a Swagelok™ connector.

4. The electric pumping system of claim 1, wherein the protector comprises a labyrinth style protector device.

5. The electric pumping system of claim 1, wherein the protector comprises a bag style protector device.

6. The electric pumping system of claim 1, wherein the protector comprises a metal bellows style protector device.

7. The electric pumping system of claim 2, wherein the hydraulic connector comprises a one-way check valve that only allows flow into the protector part.

8. The electric pumping system of claim 1, comprising an injection pump at surface, the injection pump being in hydraulic connection with the oil container and the conduit, wherein the injection pump pumps motor oil from the oil container into and down the conduit thereby creating a positive pressure in the motor part.

9. The electric pumping system of claim 1, comprising a wellhead at surface of the well.

10. The electric pumping system of claim 1, comprising a sensor connected adjacent to the motor part, the sensor detecting at least one selected from the following list: vibration, temperature and pressure.

11. The electric pumping system of claim 1, comprising production tubing connecting with the pumping part of the electric submersible pump and extending to the wellhead.

12. A method of pumping fluid from a subterranean well, comprising:

locating an electric submersible pump downhole, the electric submersible pump comprising a motor part, a protector part and a pump part;

operatively coupling the motor part to the pump part with the protector part positioned between the motor part and the pump part;

locating a motor oil container at surface;

connecting the motor oil container hydraulically with an internal volume of the electric submersible pump that contains motor oil to supply motor oil to both the motor part and the protector part by coupling an oil line to a base of the protector part, which in turn is directly coupled to the top of the motor; and pumping motor oil from the oil container at surface through the oil line and into the electric submersible pump while the electric submersible pump is located downhole.

13. The method of claim 12, comprising connecting an injection pump hydraulically with the oil container at surface and the oil line, and operating the injection pump to pump motor oil from the oil container through the oil line and into the protector part, thereby creating a positive pressure situation in the motor part.

14. The method of claim 12, comprising connecting the motor oil container hydraulically with an internal volume of the protector part via a hydraulic connector in a protector base.

15. The method of claim 12, comprising pumping the motor oil into the electric submersible pump while the motor of the electric submersible pump is running.

* * * * *